US005511951A

United States Patent [19]

O'Leary

[11] Patent Number: 5,511,951

[45] Date of Patent: Apr. 30, 1996

[54] IV FLUID DELIVERY SYSTEM

[76] Inventor: Stephen H. O'Leary, 317 Village Run West, Encinitas, Calif. 92024-3059

[21] Appl. No.: 287,853

[22] Filed: Aug. 8, 1994

[51] Int. Cl.[6] ..... F04B 43/12

[52] U.S. Cl. ..... 417/53; 417/474; 604/153

[58] Field of Search ..... 417/474, 478, 417/479, 53; 604/153

[56] References Cited

U.S. PATENT DOCUMENTS

| | | | |
|---|---|---|---|
| 3,433,171 | 3/1969 | Corneil | 417/474 |
| 3,518,033 | 6/1970 | Anderson | 417/478 |
| 3,606,596 | 9/1971 | Edwards | 417/479 |
| 4,302,164 | 11/1981 | Manella | 417/474 |
| 4,653,987 | 3/1987 | Tsuji et al. | 417/474 |
| 5,092,749 | 3/1992 | Meijer | 417/479 |
| 5,116,203 | 5/1992 | Natwick et al. | 417/474 |
| 5,152,680 | 10/1992 | Okada | 417/474 |
| 5,165,873 | 11/1992 | Meijer | 417/474 |
| 5,320,502 | 6/1994 | Davis | 417/474 |
| 5,320,503 | 6/1994 | Davis | 417/474 |

OTHER PUBLICATIONS

Copending U.S. Application No. 08/287,624, filed Aug. 8, 1994.

Copending U.S. Application No. 08/287,625, filed Aug. 8, 1994.

Copending U.S. Application No. 08/287,854, filed Aug. 8, 1994.

*Primary Examiner*—Peter Korytnyk

*Attorney, Agent, or Firm*—Fulwider Patton Lee & Utecht

[57] ABSTRACT

An IV fluid delivery system for use with a resilient, deformable tube, wherein a mechanism is provided to deform and occlude said tube by a plurality of fingers, as well as, to restore the cross-sectional area of said tube by those fingers, so as to improve the accuracy, consistency, and predictability of flow through the tube.

18 Claims, 4 Drawing Sheets

IV FLUID DELIVERY SYSTEM

BACKGROUND OF THE INVENTION

This invention generally relates to fluid delivery systems that are used to administer medical solutions to patients intravenously. More specifically, the invention relates to intravenous (IV) infusion pumps with a mechanism for improving the predictability, consistency, reliability, and accuracy of fluid flow.

Physicians and other medical personnel apply IV infusion therapy to treat various medical complications in patients. For safety reasons and in order to achieve optimal results, it is desirable to administer the IV fluid in accurate amounts as prescribed by the physician and in a controlled fashion. Certain IV delivery systems used a simple arrangement, whereby the IV fluid flows from an elevated reservoir via a length of flexible tubing connected by a catheter or the like to the patient's vascular system. In these systems, a manually adjustable clamp is used to apply pressure on the tubing to control the cross-sectional area of the tube opening to thereby control the flow rate. However, due to factors such as temperature changes which can affect the shape of the tubing, and the unpredictability of the interaction between the tubing and the clamp, such systems have not proven to be very accurate in controlling and maintaining a prescribed fluid flow rate over an extended period of time. Moreover, delivery pressure is limited in a practical sense by the head height of the fluid source and, in many instances, a greater delivery pressure is required to accomplish the desired IV infusion to the patient.

Over the years, various devices and methods have been developed to improve the administration of IV fluids under positive pressure in a controlled and accurate fashion. One such example can be found in peristaltic pumps which act on a portion of the tubing carrying the IV fluid between a fluid reservoir and the patient to deliver fluid under pressure and to control the flow rate. More specifically, a peristaltic pump is a mechanical device that pumps the fluid in a wave-like pattern by sequential deformation and occlusion of several points along the length of the resilient, deformable tubing which carries the IV fluid. Operation of such a pump typically involves a mechanical interaction between a portion of the resilient, deformable tubing, a peristaltic mechanism (i.e., a mechanism capable of creating a wave-like deformation along the tube), a pressure pad for supporting the tube, and a drive mechanism for operating the peristaltic mechanism.

In such a system, the tubing is placed between the peristaltic mechanism and the pressure pad so that the peristaltic mechanism can sequentially deform and create a moving zone of occlusion along the portion of the tube. The speed of the drive mechanism may be adjusted to control the pumping cycle and to achieve the desired flow rate. As known by those skilled in the art, peristaltic pumps have provided a major improvement over older methods in achieving consistency and accuracy in the flow rate of the IV fluid.

It has been found desirable to increase the uniformity of the fluid flow rate, and one factor that directly affects fluid flow in a peristaltic pump is the cross-sectional area of the tube lumen or opening. Generally, IV sets that are used with peristaltic pumps have resilient, deformable tubes (typically made of PVC) with circular cross sections, although other shapes may also be used. In order to provide further control over the flow rate, it is desirable to maintain the original cross-sectional area of the tube.

In many of the above mechanisms, after a portion of the tube is deformed under the force of the peristaltic mechanism and the peristaltic mechanism is no longer providing force against the tube, the mechanism relies on the fluid that is under pressure to assist the deformed tube to open up as well as on the elastic nature of the tube to restore its shape to the undeformed state. However, as the portion of the tube that interacts with the peristaltic pump is repeatedly deformed between the pressure pad and the peristaltic mechanism, the resiliency of the tube can be compromised and instead of the tube restoring itself to its original shape after each deformation, a non-elastic deformation of the tube may occur. While there are tubes that exhibit various degrees of resiliency, even the IV sets with highly resilient tubes, which typically are more expensive and may have to be custom made, may experience a short-term or long-term deformation as a result of counter forces exerted on the tube by the peristaltic mechanism and the pressure pad. Such a deformation may occur despite efforts to design and manufacture the components of the pump with appropriate tolerances for relieving excessive forces that may be generated between various components of the pump. An effect of such deformation of the tube is that it generally alters the cross-sectional area of the tube lumen and may reduce the amount of fluid flow to the patient per each occlusion of the tube by the peristaltic mechanism. As can be appreciated by those skilled in the art, such an occurrence is undesirable.

Also, in many of the previously designed pump mechanisms, the deformation of the tube between the peristaltic mechanism and the pressure pad occurs from the same directions throughout the operation of the pump. Such a design may increase the possibility of creating a permanent deformation in the tube.

Thus, there is a need for an IV pump with a mechanism that substantially restores the shape of the tube to reduce the possibility of permanent deformation and change in the cross-sectional area of the inner lumen of the tube. Such a pump mechanism would enhance the accuracy, reliability, consistency, and predictability of fluid flow. The present invention fulfills these needs.

SUMMARY OF THE INVENTION

Briefly, and in general terms, the present invention is directed to a fluid delivery pump with a mechanism that occludes as well as restores the shape of a portion of a resilient, deformable IV tube that carries IV fluid to the patient, and more particularly to such a pump with a mechanism for improving the predictability, consistency, reliability, and accuracy of fluid flow rate through the IV tube and extending the useful life of the tube. After each deformation and occlusion of the portion of the tube, the mechanism incorporated in the pump of the invention urges the previously occluded portion of the tube to first substantially restore its cross-sectional shape and then deform and occlude that portion of the tube. By urging the restoration of the shape of the tube, the mechanism of the present invention serves to provide a consistent lumen size in the tube, so that the volume of fluid displaced by each pumping cycle remains substantially constant over time.

More specifically, a peristaltic pump in accordance with the present invention includes a drive mechanism that rotates a cam shaft which carries a series of cams positioned along its length. Each cam is associated with a peristaltic finger (follower) that is spring loaded to make contact with the cam, and is designed to deform and occlude a resilient, deformable tube carrying IV fluid to the patient against a pressure pad. The fingers are alternately positioned on opposite sides of the cams so as to create finger pairs comprising a right and a left hand finger in each pair. Accordingly, cam pairs are formed of two adjacent cams which are in contact with a right and a left hand finger pair. As the cam shaft and the cams rotate, the upper portion of each finger makes contact with its associated cam, and the fingers pivot around a stationary pivot shaft (left hand fingers pivot around left pivot shaft and right hand fingers pivot around right pivot shaft). As a result, the lower portion of each finger advances in a rocking motion to sequentially apply pressure on the tube to deform and occlude it against the pressure pad. After the tube is occluded, the finger retracts to release the pressure from the tube.

One aspect of the invention includes the use of a V-shaped pressure pad with cylindrical left and right side walls designed to accommodate the arcing motion of the lower portion of the fingers in different directions. The side walls of the V-shaped pad are designed with an appropriate radius of curvature to accommodate the arcing motion of the fingers. The pressure pad is incorporated in the door of the pump which is opened in order to load the tubing therein. In order to relieve excessive forces that may be applied on the tube between the fingers and the pad, the pressure pad is preferably spring-loaded toward the fingers.

Also, in another aspect of the invention, a mechanism is included that is actuated by the opening of the door which causes the fingers that are at or near their advanced positions to retract so as to allow the tubing to be placed between the V-shaped pad and the fingers. Alternatively, the invention includes a mechanism whereby the opening of the door causes the cam shaft and the cams to move away from the fingers. Such a movement in turn forces the fingers that were not retracted to retract and make space for the placement of the tubing in the pump of the invention.

In another aspect of the present invention, the two fingers forming a finger pair act on the same axial length of the tube, and alternately occlude and urge the tubing to be restored back to its original shape. For example, during its closing stroke (moving to its advanced position), the right hand finger first comes in contact with the tubing which has been previously occluded by the left hand finger and is resting against the left side wall of the pressure pad. As the right hand finger continues its rocking motion, its contact surface urges the tubing to restore its original shape. Then, the contact surface of the right hand finger continues its rocking motion until the tubing is deformed and occluded against the right side wall of the pressure pad. Before the right hand finger begins its closing stroke, the left hand finger assumes its retracted position, and remains in that position until the right hand finger has occluded the tubing and then retracted from the path of the left hand finger. After occluding the tubing, the right hand finger retracts and the left hand finger begins its closing stroke to urge the flattened tubing to restore its original shape, followed by pressing the tubing against the left side wall of the pressure pad until it is occluded.

In yet another aspect of the invention, each cam pair is oriented along the cam shaft with an appropriate phase angle from an adjacent cam pair so as to create a peristaltic action by the fingers during one complete 360° rotation of the cam shaft. For example, twelve finger pairs and twelve cam pairs are used (a different number may also be used), wherein each cam pair has a thirty degree phase angle with respect to an adjacent cam pair. In other words, the motion of cam pair number two is retarded thirty degrees from cam pair number one, and the motion of cam pair number three is retarded sixty degrees from cam pair number one, and etc. As a result, the occlusion and restoration process by opposing fingers occurs sequentially and peristaltically for all finger pairs to create a moving zone of occlusion in a wave-like pattern along the tube.

According to another aspect of the invention, a mechanism is provided to properly locate the pressure pad with respect to the fingers and to minimize the accumulation of design tolerances in the area where the tubing is being manipulated. To accomplish this, two spacers (one at each end of the pump) are mounted on the stationary left and right pivot shafts. Each spacer engages the V-shaped pressure pad to ensure the proper location and spacing of the pressure pad and the fingers.

From the foregoing, it can be appreciated that the peristaltic pump of the invention can improve the useful life of the IV tubing and increase the accuracy and consistency of the fluid flow rate through the tube. Although the tubing used in IV sets typically possess resilient characteristics, their performance in peristaltic pumps can be advantageously enhanced by the mechanism of the invention which urges the tubing to restore its shape during the pumping operation. The restoration capability of the invention serves to prevent short or long-term deformation of the tube which can cause an unpredictable or inconsistent fluid flow over a period of time. The tube restoring mechanism of the invention can also force the restoration of the tubing to take place at a faster rate as compared to natural tendencies of IV tubes to restore their shape, and thereby allows such a pump to have a higher maximum flow rate than would otherwise be possible. These and other advantages of the invention will become more apparent from the following detailed description thereof, taken in conjunction with the accompanying exemplary drawings.

DETAILED DESCRIPTION OF THE PREFERRED EMBODIMENTS

Figure 1:
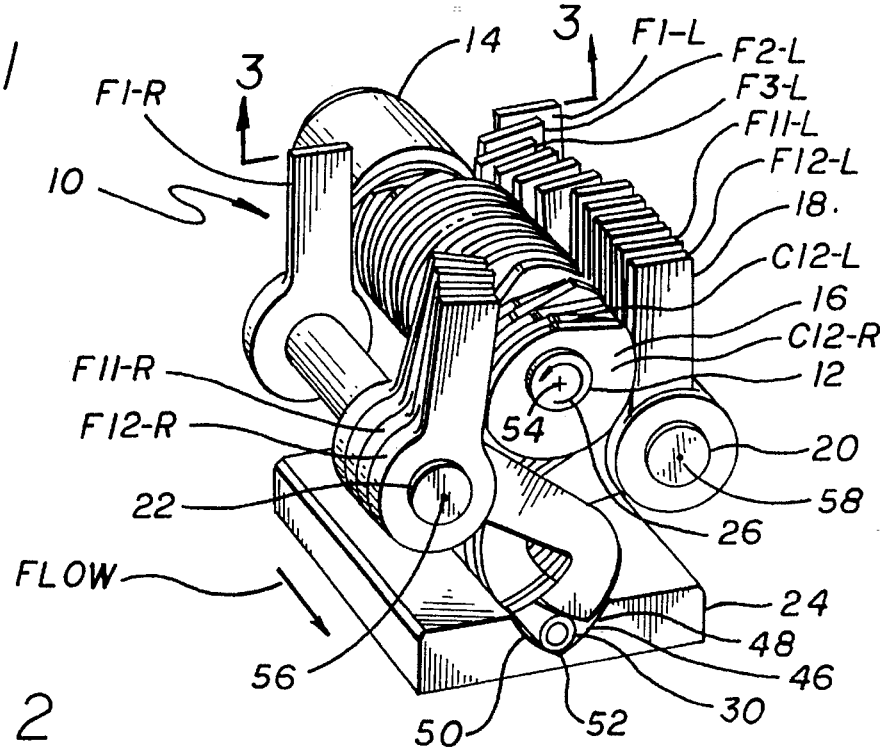
FIG. 1 is a perspective view of a pump mechanism embodying the present invention.

The present invention is embodied in a pump mechanism 10 as illustrated in FIG. 1. The pump mechanism 10 generally includes a plurality of opposing fingers 18 that alternatingly apply force to occlude as well as to restore the cross-sectional shape of a portion of a resilient, deformable tubing 30 that carries IV fluid from an elevated fluid reservoir to a patient (fluid reservoir and the patient not shown), and a rotatable cam shaft 12 that is driven by a motor 14 to provide the driving force for the movement of the opposing fingers 18.

In more detail, a portion of the tubing 30 is placed in the pump mechanism 10 between a pressure pad 24 and the plurality of the opposing fingers 18 such that the tubing 30 lies a fixed distance from and substantially parallel to the longitudinal axis of the cam shaft 12. The fingers 18 which are identical in shape form finger pairs which face one another on opposite sides (right and left sides) of their associated cams 16 which are in turn identical in shape and are mounted along the rotatable cam shaft 12. As shown in FIG. 1, the motor 14 and the cam shaft 12 rotate in a counter-clockwise direction (see arrow 26). The motor is preferably a stepper motor, however, other means that may result in the rotation of the cam shaft 12 may be used. The preferred embodiment of the invention uses twenty four cams and twenty four fingers, although a different number may also be used. As shown in FIG. 1, one finger in a each finger pair is mounted on a left stationary pivot shaft 20, and the opposing finger in each pair is mounted on a right stationary pivot shaft 22. Accordingly, the opposing fingers in each finger pair rotate about the pivot shafts 20 and 22 in a rocking motion in different directions, and alternately apply force on the same axial length of the IV tubing 30 against the pressure pad 24.

In operation, after each finger in a finger pair advances and occludes the tubing, it retracts and the other finger advances to first restore the cross-sectional shape of the tubing 30 and then to re-occlude the tubing 30. More specifically, as each finger 18 begins to advance, it first contacts the occluded tubing 30 (the tubing has already been occluded by the other finger in the pair) and urges it to restore its original cross-sectional shape, and then continues its rocking motion to deform and re-occlude the tubing against the pressure pad 24. The motion of the finger pairs occurs in a wave-like peristaltic fashion along the length of the tubing throughout the rotation of the cam shaft. To accomplish this wave-like, sequential motion, the cam pairs which are associated with the finger pairs are oriented along the cam shaft 12 with an appropriate phase angle between adjacent cam pairs.

Figure 2:
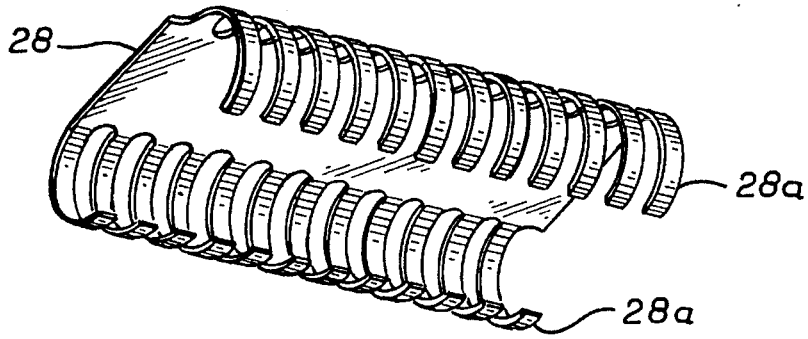
FIG. 2 is a perspective view of a certain structure of the pump mechanism shown in FIG. 1, namely the finger biasing spring that acts on finger pairs.
Figure 3:
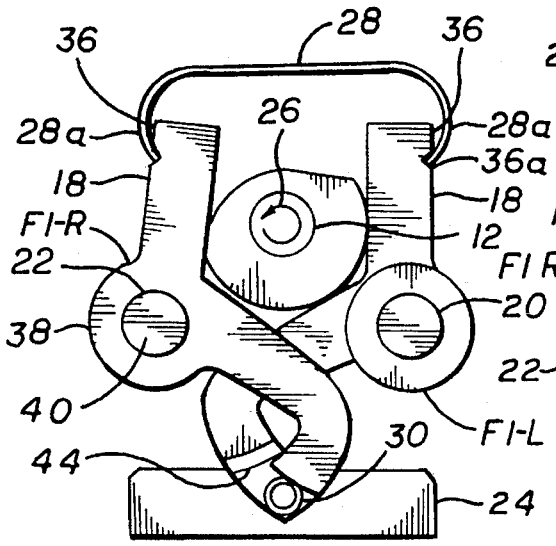
FIG. 3 is an end view, taken at line 3—3, of the pump mechanism shown in FIG. 1, showing the number one finger pair.
Figure 4:
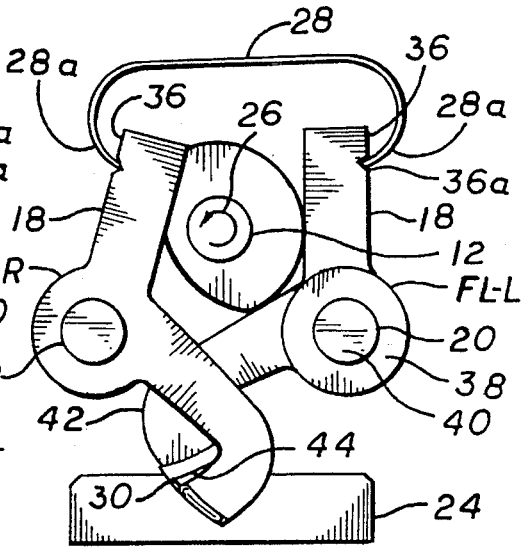
FIG. 4 is an end view similar to FIG. 3, except that certain operative parts are shown in different positions.

In order to maintain contact with its associated cam 16, each finger 18 is biased by a finger biasing spring 28. The preferred embodiment of the finger biasing spring 28 with twenty four arms **28*a* for contact with twenty four fingers can be seen in FIG. 2. For the sake of clarity, finger biasing spring 28 is not shown in FIG. 1. However, as shown in FIGS. 3 and 4, each arm 28*a* of the finger biasing spring 28 is seated in a notch 36*a* formed on the outside of an upper portion 36 of each of the fingers. Instead of this self-aligning method, other methods may be used to engage the finger biasing spring 28 with the fingers. The individually flexible nature of each arm 28*a* of the finger biasing spring shown in FIG. 2 allows each arm to deflect as necessary by the finger 18** that it is in contact with.

Each finger 18 is comprised of an upper portion 36 which makes contact with a cam 16, followed by a round portion 38 having a round aperture 40 therein, and a lower portion 42 which terminates with a contact surface 44 that applies force on the tubing 30. In each of the fingers 18, the upper portion 36 and the lower portion 38 are less than half as wide as the round portion 38 and the contact surface 44. The contact surface 44 of the lower portion 42 is wide enough to cover the tubing 30 in a flattened condition. Viewing from the downstream end of the pump (i.e., looking in the upstream direction), the fingers which have their contact surfaces positioned on the right side of the tubing 30 are referred to as right hand fingers and those with contact surfaces on the left side of the tubing as left hand fingers. Also, the cams associated with the right hand fingers are referred to as right cams and those acting on left hand fingers as left cams. With these directional conventions defined, finger pairs and cam pairs are formed, wherein a right hand finger is in contact with a right cam and an adjacent left hand finger is in contact with a left cam.

Also, for easy identification of specific fingers and cams, beginning with the upstream end of the pump mechanism 10, the twenty four fingers 18 are consecutively numbered F1-L, F1-R, F2-L, F2-R, F3-L, F3-R, . . . , F12-L, and F12-R, where "F" denotes "finger", "1, 2, 3, . . ." denotes "pair number", "R" denotes "right", and "L" denotes "left." Similarly, the twenty four cams 16 are consecutively numbered C1-L, C1-R, C2-L, C2-R, C3-L, C3-R, . . . , C12-L, and C12-R, where "C" denotes "cam." The cams 16 in each cam pair are oriented with a small phase angle around the cam shaft 12, but they may also be designed to be identically oriented around the cam shaft 12. Regardless of the orientation of each cam in a pair, each cam pair is phased thirty degrees from the adjacent cam pair, wherein the appropriate phase angle is derived by dividing 360 by the number of cam pairs involved; here twelve cam pairs.

The round aperture 40 of each right hand finger is pivotally mounted on the right stationary pivot shaft 22, and the round aperture 40 of each left hand finger is pivotally mounted on the left stationary pivot shaft 20. Although it can be seen in FIG. 1, that the right and left pivot shafts 20 and 22 are respectively positioned on the left and right sides of the cam shaft 12, we define the right stationary pivot shaft 22 as the pivot shaft that is associated with the right hand fingers and the left stationary pivot shaft 20 as the pivot shaft that is associated with the left hand fingers. Both pivot shafts are longitudinally parallel to the cam shaft 12, and are positioned lower than the cam shaft 12 so as to allow the upper portion 36 of each finger 18 to make contact with its associated cam 16.

To illustrate how the fingers make contact with and cause the occlusion of the tubing 30, the motion of one of the finger pairs, namely F1-R and F1-L will be described hereinafter. Referring to FIGS. 3 and 4, as the motor 14 rotates the cam shaft 12 in a counter-clockwise direction, the upper portion 36 of spring-loaded F1-L will move in a direction that is dependent on the position of C1-L. For example, as C1-L approaches the top-dead-center position (i.e., where the point of contact between the cam and the finger occurs at the largest radius of the cam), the upper portion of F1-L moves away from the cam shaft 12 to thereby cause the round portion 38 of F1-L to pivot around the left pivot shaft 20 in a clockwise direction.

This in turn causes the lower portion 42 and the contact surface 44 of F1-L to move through an arc away from the tubing 30 until C1-L reaches the top-dead-center position which brings the upper portion 36 of F1-L to an orientation such that its contact surface 44 assumes its fully retracted position. As the cam shaft 12 continues to rotate, the contour of C1-L is designed to maintain the cam in the top- dead-center position so as to allow F1-R to go through its closing stroke without interference with the contact surface of F1-L. Once F1-R occludes the tube, it then retracts until C1-R reaches the top-dead-center position.

At this point in the operational cycle, the upper portion 36 of F1-R is furthest away from the cam shaft 12 and its contact surface is fully retracted. When F1-R is fully retracted, C1-L begins to rotate away from the top-dead-center position. This forces the upper portion of F1-L to pivot around the left pivot shaft 20 in a counter-clockwise direction. This in turn moves the lower portion 42 and the contact surface 44 of F1-L through an arc to apply force on tubing 30. When C1-L is in the bottom-dead-center position (i.e., where the point of contact between the cam and the finger occurs at the smallest radius of the cam), the contact surface 44 of the F1-L pinches and occludes the tubing 30 against the pressure pad 24. Each cam is designed so that each finger will remain at the pinched-off (occluded) position for approximately 15° of cam shaft rotation, and also remain at the fully retracted position long enough for the opposite facing finger in a finger pair to advance on and retract from the tubing without interference. However, other contours for the cams may be selected to accomplish the desired movement of the fingers.

To better understand the sequence of the movement of fingers, the relationship between the approximate motion of the fingers in finger pair number one is described hereinafter (other finger pairs have a similar relationship). In the description that follows, it must be noted that the position of the cam shaft which causes F3-L and F9-R to occlude the tubing is marked as the 0° position of cam shaft rotation as a reference.

The cycle begins with F1-R fully retracted but starting its closing (restoring and pumping) stroke. After an occlusion of the tubing for about fifteen degrees of cam shaft rotation (from approximately 112.5° to 127.5° of cam shaft rotation), F1-R retracts as quickly as possible. Once F1-R is fully retracted, F1-L advances without interference from F1-R to urge the tubing to restore its cross-section, and then continues its motion until it occludes the tubing. After a dwell at the occluded position for about fifteen degrees of cam shaft rotation (from approximately 292.5° to 307.5° of cam shaft rotation), F1-L retracts as quickly as possible, and F1-R is ready to move toward the tubing to repeat the cycle.

The above-described cycle repeats itself with every complete rotation of the cam shaft 12, and is the same for all finger pairs in the pump, except that the movement of each finger pair is phased thirty degrees with respect to the movement of the adjacent pair (i.e., the position of finger pair number two is retarded by 30° with respect to finger pair number one, and the position of finger pair number three is retarded by 30° with respect to finger pair number two, and etc.). The relationship between the positions of the twenty-four right and left hand fingers may be seen from Table 1 (see below) which shows the degrees of cam shaft rotation from its 0° reference point at which each finger is in its advanced position and occludes the tubing.

TABLE 1

| | Closed Position of Fingers (±7.5°) (Based on degrees of cam shaft rotation) | | | | | | | | | | | |
|---|---|---|---|---|---|---|---|---|---|---|---|---|
| Pair No. | 1 | 2 | 3 | 4 | 5 | 6 | 7 | 8 | 9 | 10 | 11 | 12 |
| Left Finger | 300 | 330 | 0 | 30 | 60 | 90 | 120 | 150 | 180 | 210 | 240 | 270 |
| Right Finger | 120 | 150 | 180 | 210 | 240 | 270 | 300 | 330 | 0 | 30 | 60 | 90 |

Referring to Table 1, at any given point during the rotation of the cam shaft, two fingers (not of the same pair) are occluding the tubing. For example, at 0° (±7.5°) of cam shaft rotation, F3-L and F9-R occlude the tubing, and at 90° (±7.5°) of cam shaft rotation, F12-R and F6-L occlude the tubing, and etc. As described earlier, each finger assumes its advanced or closed position for a 15° rotation of the cam shaft, and the closed position of each finger in Table 1 has a range of ±7.5° of cam shaft rotation in order to represent the 15° dwell time.

The lower portion 42 of the fingers 18 is designed such that the contact surfaces of a finger pair alternately act on the same axial length of the tubing. Therefore, the right hand finger of a pair must move through an arc and retract before the left hand finger may move down toward the tubing and vice versa. Given the width of contact surface 44 of the fingers, each finger in a pair must move through an arc (in this case fifteen degrees) in order to clear the contact surface of the opposite finger.

In order to accommodate the arcing movement of the contact surface of each finger in a pair in opposite directions, pressure pad 24 has a V-shaped groove 46 with a pair of right and left cylindrical side walls 48 and 50 (see FIG. 1). The V-shaped groove 46 has a pointed tip 52 which is located directly under the center 54 of cam shaft 12. Also, the center of the radius of curvature of the right side wall 48 is located at the center 56 of the right pivot shaft 22, while the center of the radius of curvature of the left side wall 50 is located at the center 58 of the left pivot shaft 20. The radius of curvature of the two side walls of the V-shaped pad is chosen to accommodate the arcing motion of the fingers. However, it is important to keep close tolerances between the contact surfaces of the fingers and the pressure pad so that the tubing will not get caught between the finger and the pressure pad.

Figure 5:
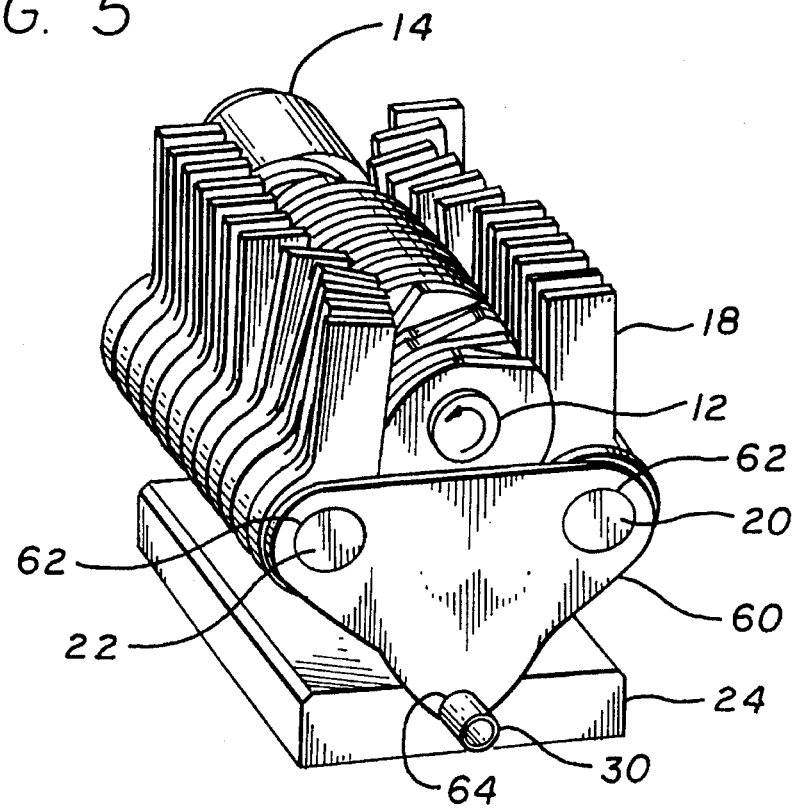
FIG. 5 is a perspective view of the pump mechanism shown in FIG. 1, showing another structure, namely a spacer, at the downstream end of the pump mechanism.

With reference to FIG. 5, at least one, but preferably a pair of spacers 60 (one at each end of the pump) are provided to minimize the accumulation of design tolerances in the area where the tubing is being manipulated by ensuring the proper location and spacing of the pressure pad 24 with respect to fingers 18. Although FIG. 5 only shows one spacer at the downstream end of the pump, each spacer 60 has a triangular shape (other shapes could also be used) with two apertures 62 at two of its corners. The apertures 62 are mounted on the right and left pivot shafts 22 and 20, and the third corner of the spacer 60 has a surface adapted to engage the V-shaped groove 46 of the pressure pad 24. A notch 64 is provided in the third corner of the spacer 60 to allow the passage of the tubing 30 and to allow the proper positioning of the tubing into the mechanism during loading.

Figure 6:
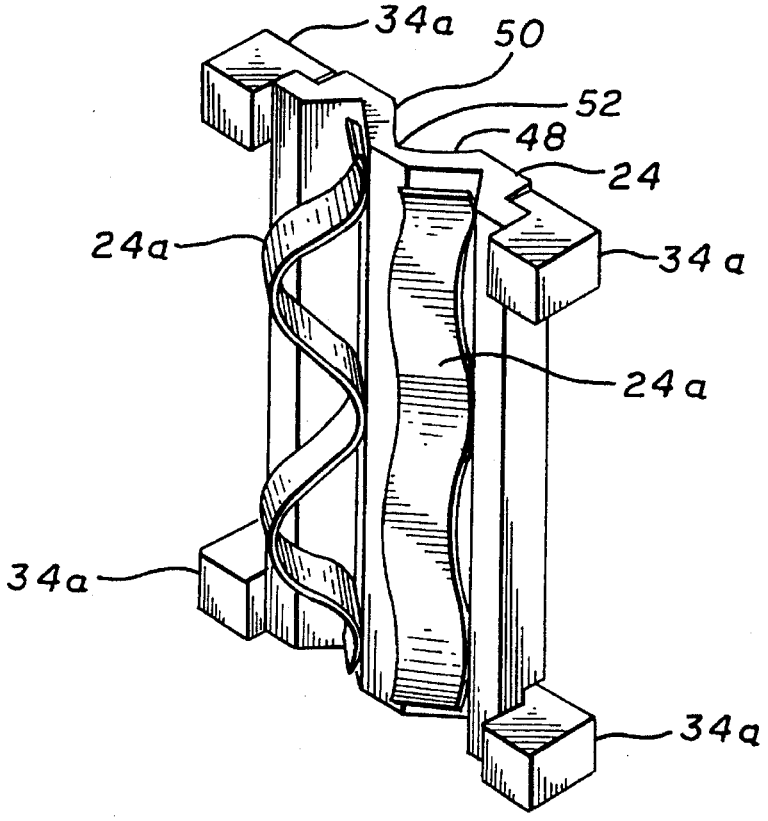
FIG. 6 is a perspective view of another structure of the pump mechanism shown in FIG. 1, namely the pressure pad.

With reference to FIGS. 6–10, the pressure pad 24 is incorporated in a door 34 of the pump via door-mounted retainers **34*a* that hold both ends of the pressure pad secured to the door. The door 34 is preferably hinged and latched to the front panel 34***b* of the pump instrument (latching mechanism not shown). The pressure pad is biased against the tubing 30 by pressure pad springs 24*a* located between the door 34 and the underside of the right and left cylindrical side walls 48 and 50 of the pressure pad. As shown in FIG. 6, the pressure pad springs 24*a* are preferably two leaf springs located along the length of the pressure pad. However, other biasing means such as coil springs (not shown) located at each end of the pressure pad side walls may alternatively be used. The pressure pad 24 is biased by the pressure pad springs 24*a* against the spacers 60 with enough force to ensure that it will not be dislodged by the force of the tubing being occluded.

In order to load the tubing 30 in the pump mechanism 10 of the invention, after the door 34 is opened, a portion of the tubing 30 is placed either inside the V-groove of the pressure pad 24 or through the spacer notches 64 and across the contact surfaces 44 of the fingers, and then the door is closed. However there are special considerations to ensure the proper loading of the tubing. If the door were closed on the tubing with some fingers in the advanced position, the tubing could be improperly lodged between those fingers and the pressure pad. To prevent this situation, the pump mechanism 10 of the invention includes a mechanism actuated by the opening of the door 34 which causes the fingers that are at or near their advanced position to retract (e.g., from a position such as that of F1-R in FIG. 4 to a position such as that of F1-R in FIG. 3) so as to allow the tubing to be aligned correctly between the V-shaped pad and the fingers.

Figure 7:
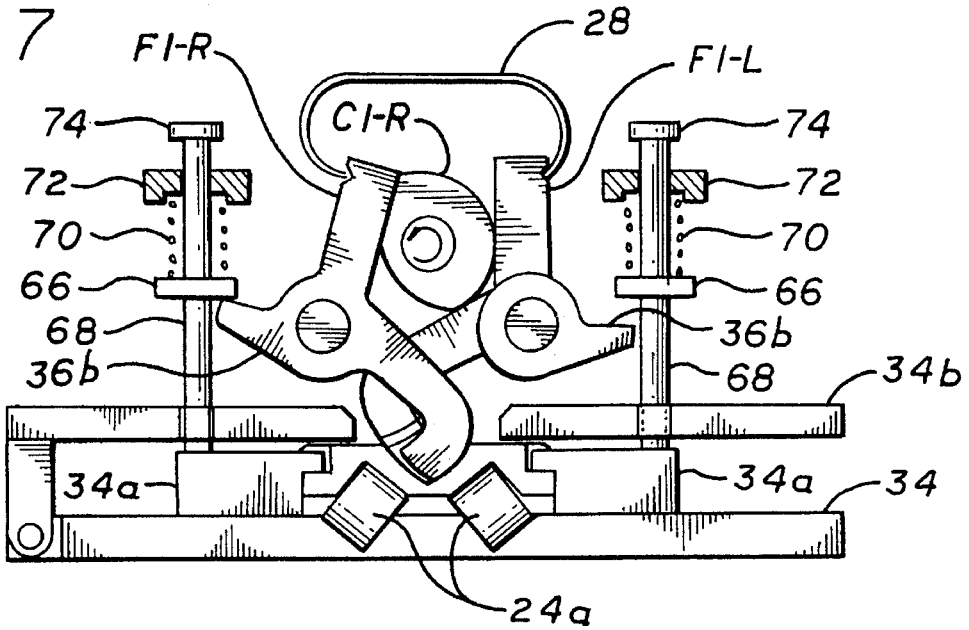
FIG. 7 is an end view, taken at line 3—3, of the pump mechanism shown in FIG. 1, wherein a finger retracting mechanism is shown.
Figure 8:
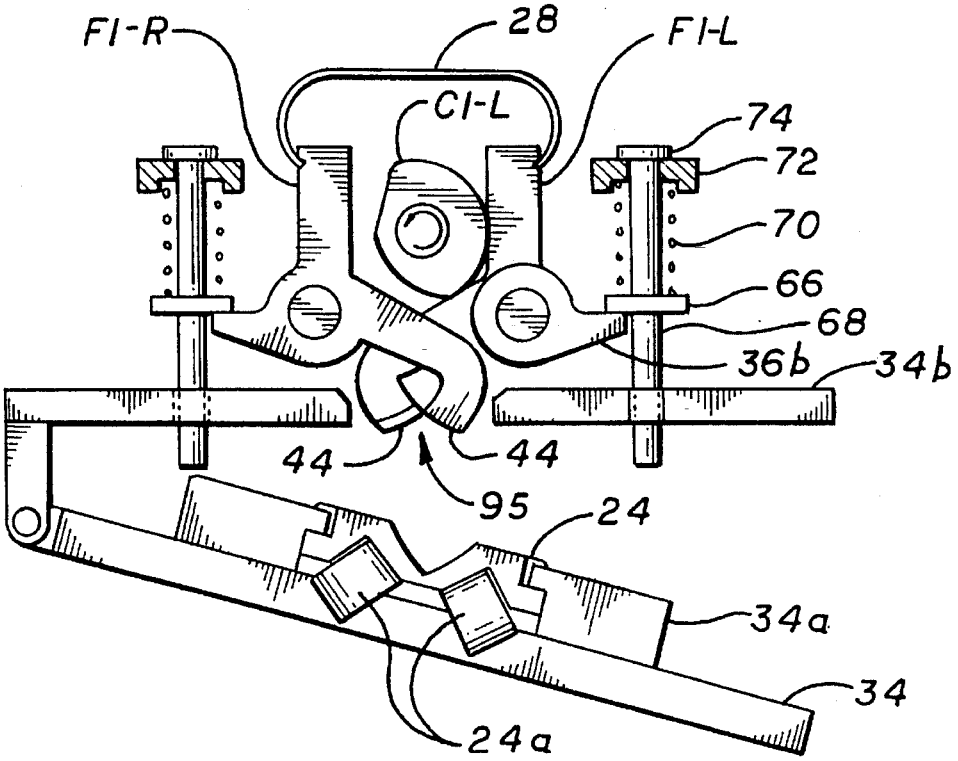
FIG. 8 is an end view similar to FIG. 7, except that certain operative parts are shown in different positions.

One such mechanism is shown in FIGS. 7 and 8 (only finger pair number one is shown for clarity). In this mechanism, the round portion 36 of each finger has a protrusion 36*b* which can be engaged by activator plates 66 located on the outside of each of the pivot shafts 20 and 22. The activator plate 66 is attached to activator pin 68, and is urged toward the door 34 by an activator spring 70 (e.g., coil spring) which is placed between the activator plate 66 and a stationary spring seat 72. However, the movement of the activator pin 68, and therefore the activator plate 66, are limited by door-mounted pressure pad retainers 34*a* (see FIG. 7). When the door 34 is opened, the activator spring 70 moves the activator plate 66 downward toward the door until activator pin head 74 comes in contact with the spring seat 72. As the activator plate 66 moves downward, the contact between the activator plate 66 and the protrusion 36*b* of those fingers which are in the advanced or pinching position causes those fingers to be retracted. With all of the fingers retracted, a suitable V-groove 95 is formed to receive the tubing which is to be loaded.

In the above finger retraction mechanism, there are preferably two activator pins 68 and two activator springs 70 located at the upstream and downstream ends of the pump mechanism on the outside of the right and left pivot shafts 22 and 20. Also, the activator plate 66 is preferably a continuous plate running between each pair of the activator pins 68 (i.e., one activator plate for the right hand fingers and one for the left hand fingers). Furthermore, the activator springs must be strong enough to overcome the force of several arms 28*a* of the finger biasing spring 28 (those teeth that are in contact with fingers which are not yet fully retracted).

Figure 9:
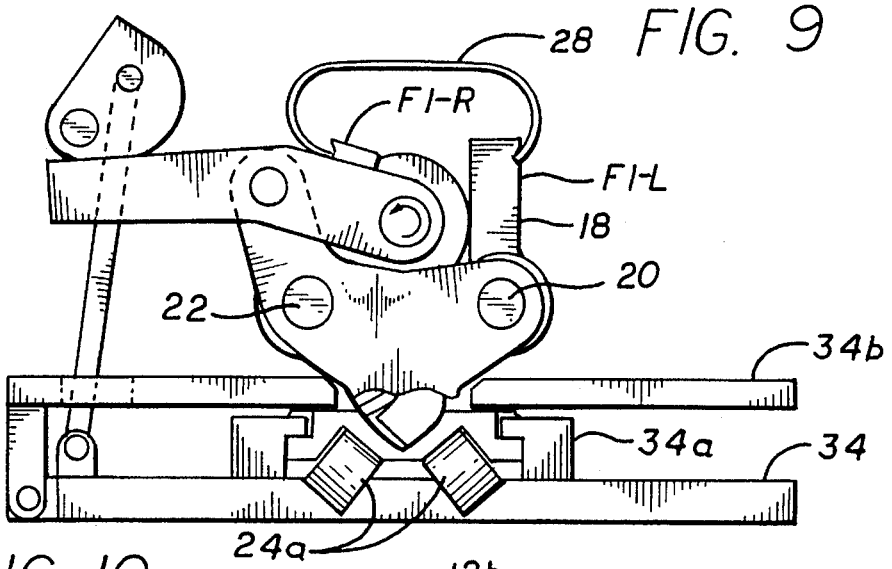
FIG. 9 is an end view, taken at line 3—3, of the pump mechanism shown in FIG. 1, wherein an alternative finger retracting mechanism is shown.
Figure 10:
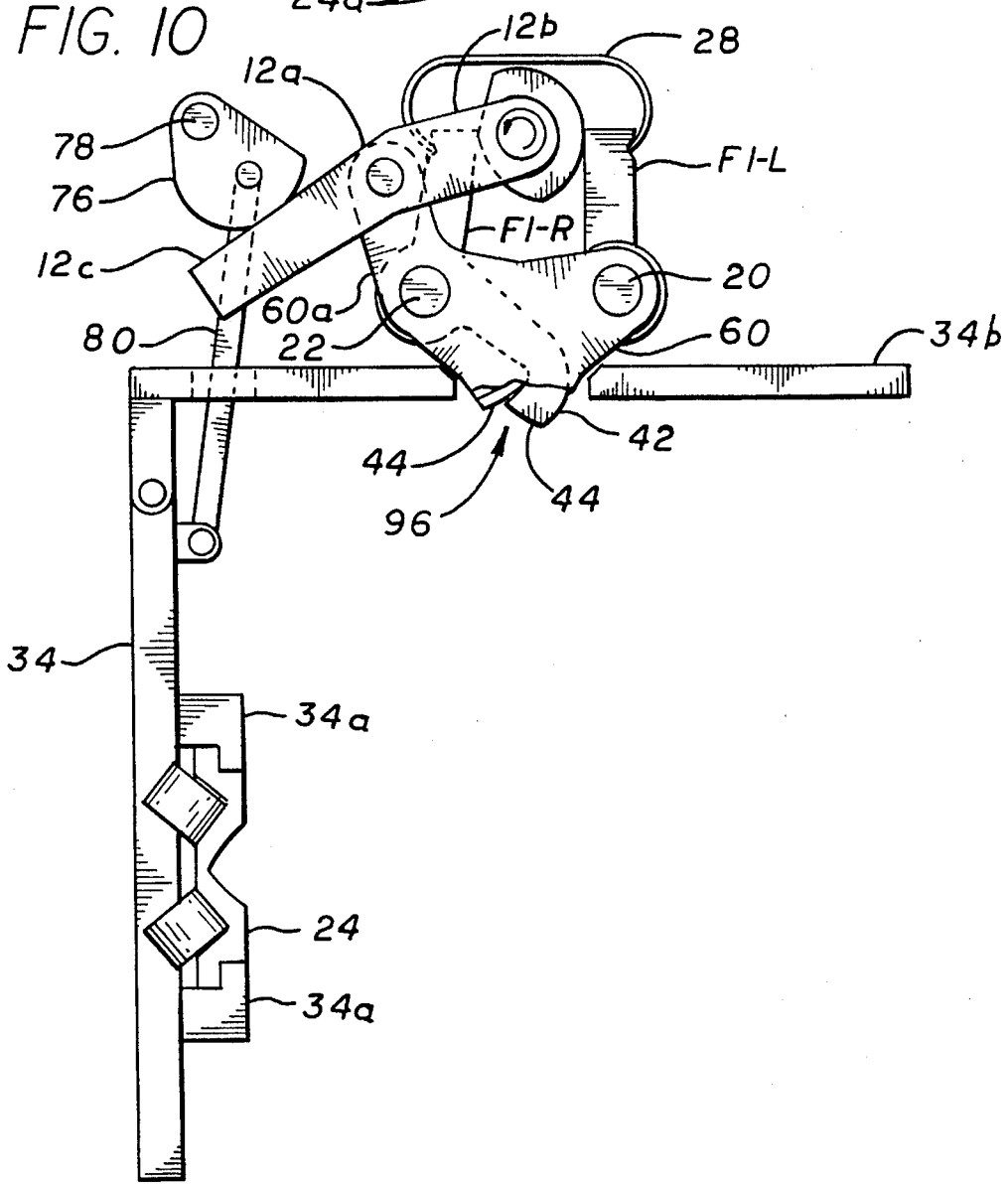
FIG. 10 is an end view similar to FIG. 9, except that certain operative parts are shown in different positions.

Alternatively, as shown in FIGS. 9 and 10, another finger retraction mechanism can be provided whereby upon opening of the door 34, the cam shaft 12 and thereby the cams 16, are moved upward in a vertical line of symmetry between the pivot shafts 20 and 22. The movement of the cams upward and away from the door does not affect the fingers that were already retracted, but it causes those fingers that were not retracted to be retracted by an amount which depends on the position of the respective cam. Once the fingers are retracted, a reasonable V-groove 96 will be formed by the fingers for placement of the tubing to be loaded.

More specifically, FIGS. 9 and 10 show a downstream end view of the pump mechanism (showing only finger pair number one for clarity) with the lower portion of the spacer plate 60 broken away to allow viewing of the lower portion 42 of the fingers 18. It must be noted that the finger retraction mechanism shown in FIGS. 9 and 10 and described hereinafter also exists at the upstream end of the pump. In this alternative embodiment of the finger retraction mechanism, the spacer plate 60 has been modified, so that its upper portion has an extension arm 60*a* which is pivotally connected to approximately the middle of a cam shaft lever 12*a*. The cam shaft 12 is supported at both its ends by first end 12*b* of cam shaft levers 12*a*. Second end 12*c* of the cam shaft lever 12*a*maintains contact with and is spring loaded (spring not shown) against a lever cam 76 which may rotate about or with a lever cam shaft 78. A linkage arm 80 is pivotally connected at its lower end to the door 34 and at its upper end to the lever cam 76.

Due to the connection of linkage arm 80 between the door and the lever cam, as the door is opened, the linkage arm 80 moves downward, causing the lever cam 76 to rotate about the central axis of the lever cam shaft 78. The rotation of the lever cam 76 forces the second end 12*c* of the cam shaft lever 12*a* to move downwards which results in the rotation of the middle portion of the cam shaft lever 12*a*. In turn, this rotation causes the first end 12*b* of the cam shaft lever 12*a* to move upwards. As the first end 12*b* of the cam shaft lever moves upwards, the cam shaft 12 and all of the cams 16 move in the same direction away from the door. As stated above, the upward movement of the cams 16 forces those fingers that were not already retracted, to retract by an amount which depends on the position of each respective cam. The retraction of the fingers will then allow the tubing 30 to be loaded between the pressure pad 24 and the contact surfaces 44 of the fingers without the danger of improperly lodging the tubing between the fingers and the pressure pad.

The pump mechanism 10 of the invention is designed to accommodate the use of IV tubing with normal variations in wall thickness and material stiffness. In order to ensure that such variations do not compromise the occlusion of the tubing, each cam is designed to allow the fingers to move far enough to pinch off (occlude) the thinnest walled tubing that may typically be used with the pump. If a thicker walled tubing is used, rather than trying to generate a large enough force needed to deform the tubing to the same level as the thin walled tubing, the fingers will lose contact with the cams while finger biasing spring 28 will limit the force and deformation of the tubing to that necessary to achieve occlusion of the tubing.

As can be appreciated, various modifications can be made to the present invention. For example, the peristaltic mechanism of the invention could be designed with fingers that would translate the motion of the cams, as opposed to rotate. However, such a configuration has several disadvantages. For example, two separate cam shafts would be required to cause the movement of the left and right hand fingers. These cam shafts would have to be separately driven, and would have to be perfectly synchronized to prevent interference between the movement of the fingers.

From the foregoing, it will be appreciated that the pump mechanism of the invention provides a mechanism with peristaltic fingers that deform and occlude the tubing as well as urge the tube to restore its cross-sectional area during the operation of the pump. This restoration ability provides a substantially consistent tube lumen size, so that the volume of fluid displaced remains substantially constant over time. Thus, the pump mechanism of the invention advantageously enhances the accuracy and reliability of the fluid flow rate, extends the useful life of IV tubing, and allows the use of low-cost IV sets. Furthermore, since many of the parts used in the pump of the invention can be identically shaped, such a pump can be economically designed and manufactured as savings can be realized by the use of several identical parts.

While particular forms of the invention have been illustrated and described, it will be apparent that various modifications can be made to the present invention without departing from the spirit and the scope thereof.

What is claimed is:

1. A method of delivering fluid through a resilient, deformable tube by using a pump mechanism having a pressure pad for supporting said tube, a plurality of finger moving in mutually orthogonal directions, and drive means for actuating said fingers, said method comprising the steps of:

placing said tube between said pressure pad and said fingers;

deforming and occluding said tube against said pressure pad under the force of said fingers directed in a first direction; and restoring the cross-sectional area of said tube under force of said fingers against said pressure pad directed in an orthogonal direction relative to said first direction.

2. A pump for delivering fluid through a resilient, deformable tube, comprising:

a pressure pad;

a first set of fingers that apply force to deform said tube against said pressure pad so as to restore and then reduce said tube's cross-sectional area;

a second set of fingers that apply force to deform said tube against said pressure pad so as to restore and then reduce said tube's cross-sectional area; and a motor operatively engaged with said fingers to actuate said fingers such that a particular section of tube is alternatively deformed by said first and second set of fingers.

3. The pump of claim 2, wherein said pressure pad is substantially V-shaped.

4. The pump of claim 2, wherein said fingers are operatively engaged with said motor through a plurality of cams associated with a cam shaft that is operatively engaged with said motor.

5. The pump of claim 4, wherein said fingers maintain contact with said cams under the force of a biasing spring.

6. The pump of claim 2, wherein said fingers pivot about a plurality of pivot shafts.

7. The pump of claim 2, wherein said pressure pad is biased against said tube and said fingers.

8. The pump of claim 2, wherein said fingers reduce said cross-sectional area so as to occlude said tube.

9. A pump for delivering fluid through resilient, deformable tube, comprising:

support means for supporting said tube;

pumping means for generating force on said tube, such that said pumping means deform said tube against said support means so as to alternatively restore and then reduce the cross-sectional area of said tube in orthogonal directions; and drive means for actuating said pumping means.

10. The pump of claim 9, wherein said pumping means includes a plurality of fingers operatively engaged with a plurality of cams along a cam shaft that is driven by the drive means.

11. The pump of claim 10, further comprising pivot means for allowing said fingers to pivot to apply force on said tube.

12. The pump of claim 11, wherein said fingers move in an arcing motion to apply force on said tube.

13. The pump of claim 12, wherein said support means is substantially V-shaped to accommodate the arcing motion of said fingers.

14. The pump of claim 9, wherein said support means is biased against said tube and said pumping means.

15. The pump of claim 9, further comprising spacer means for spacing and positioning said support means with respect to said pumping means.

16. The pump of claim 9, further comprising retraction means for changing the position of said pumping means for placement of said tube between said support means and said pumping means.

17. A pump for delivering fluid through a resilient, deformable tube comprising:

a substantially V-shaped pressure pad;

a plurality of opposing finger that apply force to deform said tube against said pressure pad as well as urge said tube to restore said tube's cross-sectional area; and a motor operatively engaged with said fingers to actuate said fingers.

18. A pump for delivering fluid through a resilient, deformable tube, comprising:

V-shaped support means for supporting said tube;

a plurality of fingers operatively engaged with a plurality of cams arranged along a cam shaft for generating force on said tube, such that said plurality of fingers move in different directions to deform said tube against said support means as well as to urge said tube to restore the cross-sectional area of said tube wherein pivot means cause said fingers to move in an arcing motion to apply force on said tube; and drive means for driving said cam shaft.

* * * * *